US006756735B2

(12) United States Patent
Lee et al.

(10) Patent No.: US 6,756,735 B2
(45) Date of Patent: Jun. 29, 2004

(54) MAGNETRON AND METHOD FOR JOINING MAGNETRON COMPONENTS

(75) Inventors: Yong Soo Lee, Shihung-shi (KR); Jong Soo Lee, Anyang-shi (KR); Jung Yeob Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/373,690

(22) Filed: Feb. 27, 2003

(65) Prior Publication Data

US 2004/0095073 A1 May 20, 2004

(30) Foreign Application Priority Data

Nov. 20, 2002 (KR) ..... 10-2002-0072436

(51) Int. Cl.[7] ..... H01J 25/50

(52) U.S. Cl. ..... 315/39.51; 315/39.53; 315/39.71

(58) Field of Search ..... 315/39.51, 39.71, 315/39.53

(56) References Cited

U.S. PATENT DOCUMENTS 4,426,601 A * 1/1984 Tsuzurahara ..... 315/39.51

6,351,071 B1 * 2/2002 Itoh ..... 315/39.51

* cited by examiner

*Primary Examiner*—David Vu

(74) *Attorney, Agent, or Firm*—Birch, Stewart, Kolasch & Birch, LLP

(57) ABSTRACT

A magnetron includes an anode having an anode cylinder and anode vanes; a cathode having a filament; a condenser, a choke coil, and a plurality of leads for providing power to the filament; a plurality of magnets, pole pieces, and a yoke for forming a magnetic circuit; an antenna feeder and an antenna cap for transmitting a generated microwave outside of the magnetron; and a plurality of joints formed of a joining material between a metal component and a ceramic component of the magnetron. The joining material is diffused between the metal component and the ceramic component, to infiltrate into an inner part of the ceramic component directly, thereby joining the metal and ceramic components, and thereby also improving a reliability of a magnetron, facilitating a simple component assembly process and a simple magnetron fabrication process, permitting simplification of the fabrication process and reduction of a fabrication cost, and saving equipment cost as a high temperature furnace can be dispensed with.

29 Claims, 10 Drawing Sheets good joint occurrence of ceramic crack
(excessive amount of infiltration)

MAGNETRON AND METHOD FOR JOINING MAGNETRON COMPONENTS

CROSS-REFERENCE TO RELATED APPLICATION

The present application claims priority under 35 U.S.C. §119 to Korean Application No. P2002-72436, filed Nov. 20, 2002, the entire disclosure of which is hereby incorporated by reference.

BACKGROUND OF THE INVENTION

1. Field of the Invention

The present invention relates in general to a magnetron which generates a microwave and, more particularly, to a magnetron and a method for joining magnetron components which can prevent vacuum leakage caused by defective joining between components.

2. Background of the Related Art

In general, a magnetron can be used in devices such as microwave ovens, plasma lighting apparatuses, dryers, and other microwave systems.

When power is applied to a magnetron, the magnetron, one of a plurality of vacuum tubes, emits thermal electrons from a cathode, which produces a microwave by interaction between a strong electric field and a magnetic field. Thus produced, the microwave is transmitted outside of the magnetron through all antenna feeder and is used as a heat source for heating all object.

The magnetron is provided with an anode having all anode cylinder and an anode vain, a cathode having a filament, a condenser, a choke coil, and leads for applying) power to the filament. A pair of magnets, a pair of pole pieces, and a yoke form a magnetic circuit. An antenna feeder and an antenna cap transmit a generated microwave outside of the magnetron.

A portion of the magnetron needs to be maintained at a vacuum. The components of this portion of the magnetron are joined together in a way that greatly affects performance of the magnetron. These components need to be joined sufficiently tightly that air cannot pass through the joints. The joints are generally made of a ceramic material component and a metal material component. To maintain proper performance of the magnetron, a technique is required for precise joining of the metal component to the ceramic component.

FIG. 1 schematically illustrates joints of filament leads and external leads of a related art magnetron. FIG. 1 shows a pair of filament leads 15 connected to a filament 11 and a pair of external leads 22 connected to a choke coil (not shown), a lower seal 14 formed of a metal forming a part of the vacuum space, and a ceramic stem 21.

Referring to FIG. 1, an upper end shield 12 and a lower end shield 13 are provided at the top and bottom, respectively, of the filament 11. The pair of filament leads 15 is provided under the lower end shield 13. The lower seal 14 maintains an airtight lower space on the inside of an anode cylinder (not shown). The ceramic stem 21 is provided under the lower seal 14. The external leads 22 are connected to the choke coil and are fitted to pass through an inside of the ceramic stem 21.

A terminal plate 23 (not shown) is provided on top of the ceramic stem 21 for connecting the pair of filament leads 15 to the pair of external leads 22. More specifically, the terminal plate 23 is made of two pieces which are not in contract. One of the filament leads 15 and one of the external leads 22 are connected to one of the pieces of the terminal plate 23. The other one of the filament leads 15 and the other one of the external leads 22 are connected to the other one of the pieces of the terminal plate 23. Thus, the pair of filament leads 15 and the pair of external leads 22 are connected from opposite sides through the two pieces of the terminal plate 23.

Because many components are joined in fabricating the foregoing related art structure, the fabricating process is very complicated. Direct brazing on the surface of the ceramic stem 21 is not possible in brazing the terminal plate 23 with a top surface of the ceramic stem 21. Because an additional metal film is formed on the top surface of the ceramic stem before joining the terminal plate 23 by brazing, metalizing is required to form a metal film on a joining surface of the ceramic stem 21.

Generally, because direct joining is not possible by general brazing methods, to more accurately join a metal component and a ceramic component, the metal component and the metal film part are joined by brazing after a metal film is formed on the ceramic component. That is, because the direct joining of the metal and the ceramic are not possible in the related art, a metalizing process is carried out for forming the metal film on the surface of the ceramic component to join metals.

This metalizing is a process in which a paste containing molybdenum Mo and manganese Mn is applied to a surface of the ceramic, and heated to an elevated temperature higher than 1600° C. to form the metal film on the surface of the ceramic. However, the metalizing not only complicates the fabrication process, it also increases the fabrication cost of the structure, since an additional furnace is required.

Moreover, the joining of filament leads 15 to one side of the terminal plate 23 and the joining of the external leads 22 to the other side of the terminal plate 22 requires a complicated process, which reduces the productivity of the structure.

Furthermore, the terminal plate 23 is thin and, therefore, susceptible to deformation, causing defects in the brazing of the terminal plate 23 with the ceramic Stem 21. This also causes difficulty in correctly positioning the filament leads 15, resulting in poor reliability and performance of the magnetron.

SUMMARY OF THE INVENTION

Accordingly, the present invention is directed to a magnetron that substantially obviates one or more of the problems due to limitations and disadvantages of the related art.

An object of the present invention is to provide a magnetron which can prevent vacuum leakage caused by defective joining between components.

Another object of the present invention is to provide a magnetron in which components can be assembled easily.

Yet another object of the present invention is to provide a method for joining components of a magnetron which can improve joining and assembly of the components.

Additional features and advantages of the invention will be set forth in the description which follows, and in part will be apparent from the description, or may be learned by practice of the invention. The objectives and other a advantages of the invention will be realized and attained by the structure particularly pointed out in the written description and claims hereof as well the appended drawings.

To achieve these and other advantages and in accordance with the purpose of the present invention, as embodied and broadly described, the magnetron includes an anode having an anode cylinder and anode vanes; a cathode having a filament; a condenser, a choke coil, and a plurality of leads for providing power to the filament; a plurality of magnets and pole pieces, and a yoke for forming a magnetic circuit; an antenna feeder and an antenna cap for transmitting a generated microwave outside of the magnetron; and a plurality of joints formed of a joining material between a metal component and a ceramic component of the magnetron, wherein the joining material is diffused between the metal component and the ceramic component, to infiltrate into an inner part of the ceramic component directly, thereby joining the metal and ceramic components.

The joint is provided at a part between an upper seal on top of the anode cylinder and an upper ceramic at a bottom of the antenna cap. The joint is further provided at a part between an exhaust pipe supporter of a metal, which supports an exhaust pipe that surrounds a top end of the antenna feeder, and an upper ceramic under the antenna cap. The joint is further provided at a part between a lower seal under the anode cylinder and a ceramic stem provided to permit pass of a plurality of leads.

The joint is further provided to an inside of an insertion hole in the ceramic stem the leads pass therethrough. The joint is further provided at a part between a filament lead connected to the filament and the external lead connected to the choke coil. The external lead has a diameter the same as or greater than a diameter of the filament lead, the external lead has a recess in an end thereof, for insertion of an end of the filament lead. The filament lead has a recess in an end thereof The external lead has a tip at all end thereof for insertion into the recess.

The joining material is an alloy of silver-copper-additive. The additive has a content of 1 to 10% in weight. The joining material has a composition ratio of silver:copper:additive in weight of 60 to 80:10 to 39:1 to 10. The additive is a material selected from at least one of titanium, tin, and zirconium, wherein the joining material may have a composition ratio of silver:copper:titanium of 60 to 80:10 39:1 to 10, a composition ratio of silver:copper: tin of 60 to 80:10 to 39:1 to 10, a composition ratio of silver:copper:zirconium of 60 to 80:10 to 39:1 to 10, or a composition ratio of silver:copper:titanium of 60 to 68:27 to 33:2 to 5.

In another aspect of the present invention, there is provided a method for joining magnetron components comprising the steps of (a) providing a joining material at parts to be joined inclusive of parts between a metal component and a ceramic component, and between a filament lead and an external lead, (b) exposing the joining material to a preset temperature and a preset environment, for diffusing the joining material into the part to be joined, to infiltrate into an inner part of the ceramic component, and (c) cooling down the joining material, to join the part to be joined.

The step (a) includes the steps of (a1) providing the joining material at a part between a lower seal under the anode cylinder and a ceramic stem, (a2) providing the joining material at a part between an upper seal on top of the anode cylinder and an upper ceramic under the antenna cap, (a3) providing the joining material at parts between an insertion hole in the ceramic stem and a filament lead passed through the insertion hole, and between the insertion hole and an external lead passed through the insertion hole, and (a4) providing the joining material at a part between the filament lead and the external lead.

The step (a3) includes the steps of rolling a sheet of the insertion material rolled into a cylindrical form, and inserting into the insertion hole, to provide the joining material to an inside wall surface of the insertion hole, and inserting the filament lead and the external leads into the insertion hole from opposite sides of the insertion hole through an inside of the cylindrical joint material. The step (a3) includes the steps of inserting a cylindrical form of the joining material already prepared into the insertion hole, to provide the joining material to an inside wall surface of the insertion hole, and inserting the filament lead and the external leads into the insertion hole from opposite sides of the insertion hole through an inside of the cylindrical joint material.

The step (a4) includes the steps of forming a depth of recess in an end of the external lead, placing the joining material in the recess, and inserting an end of the filament lead into the recess. The step (a4) includes the steps of forming a recess in an end of the filament lead, and forming a tip at an end of the external lead, placing the joining material in the recess, and inserting the tip into the recess.

The step (a) includes the step of providing a joining material to a thickness of about 50–200 $\mu$m.

The step (b) includes the step of exposing the joining material to a temperature range of about 800–1000° C., for diffusing, and infiltrating the joining material, wherein the step (b) includes the step of exposing the joining material to a vacuum, for diffusing, and infiltrating the joining material, when the vacuum is about $1\times10^{-3}$ to $1\times10^{-5}$ torr. Or alternatively, the step (b) includes the step of exposing the joining material to hydrogen gas, for diffusing, and infiltrating the joining material, or the step (b) includes the step of exposing the joining material to argon, for diffusing, and infiltrating the joining material.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings. In explaining embodiments of the present invention, the same parts will be given the same name and symbols, and iterative explanation of which will be omitted. A magnetron in accordance with a preferred embodiment of the present invention will be explained, with reference to FIG. 2.

Figure 1:
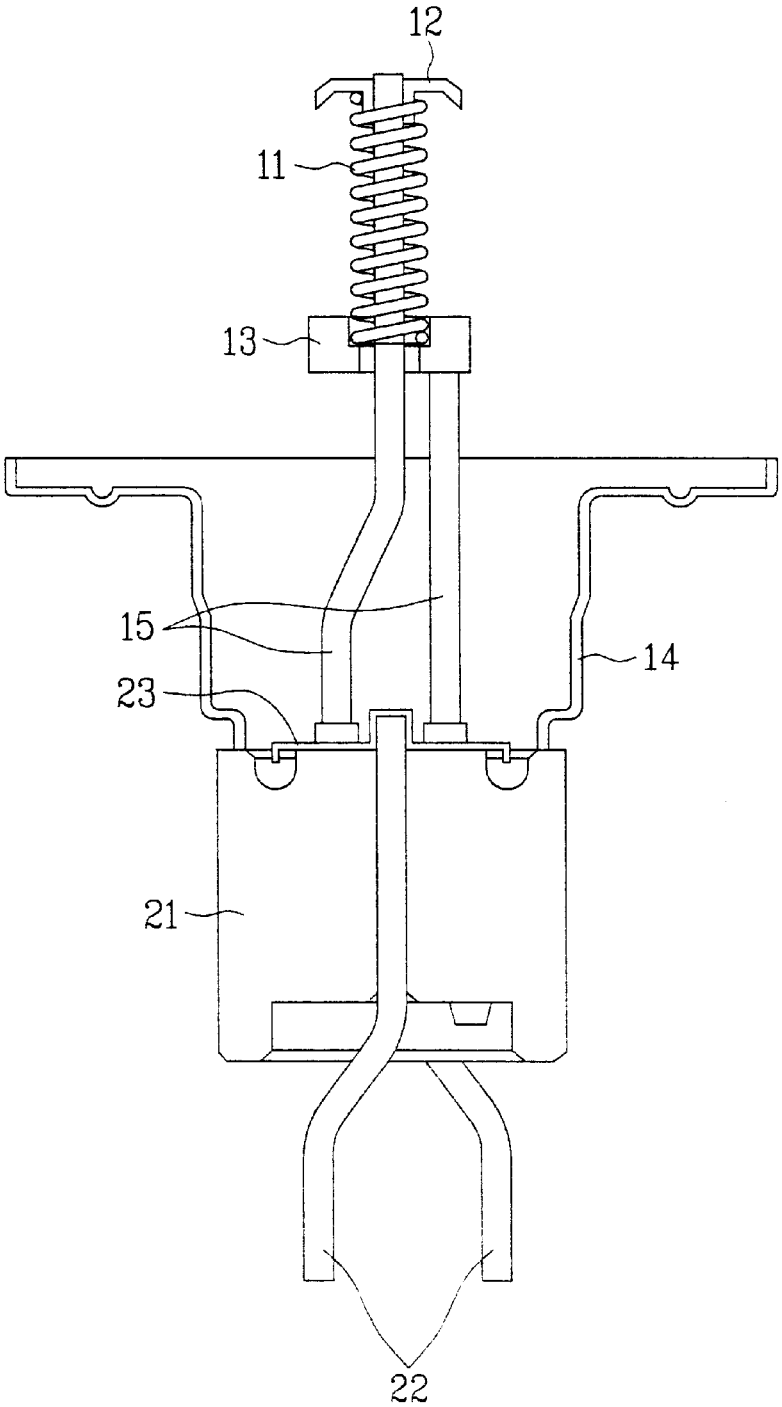
FIG.1 Prior Art
FIG. 1 illustrates a section showing joints of filament leads and external leads of a related art magnetron.
Figure 2:
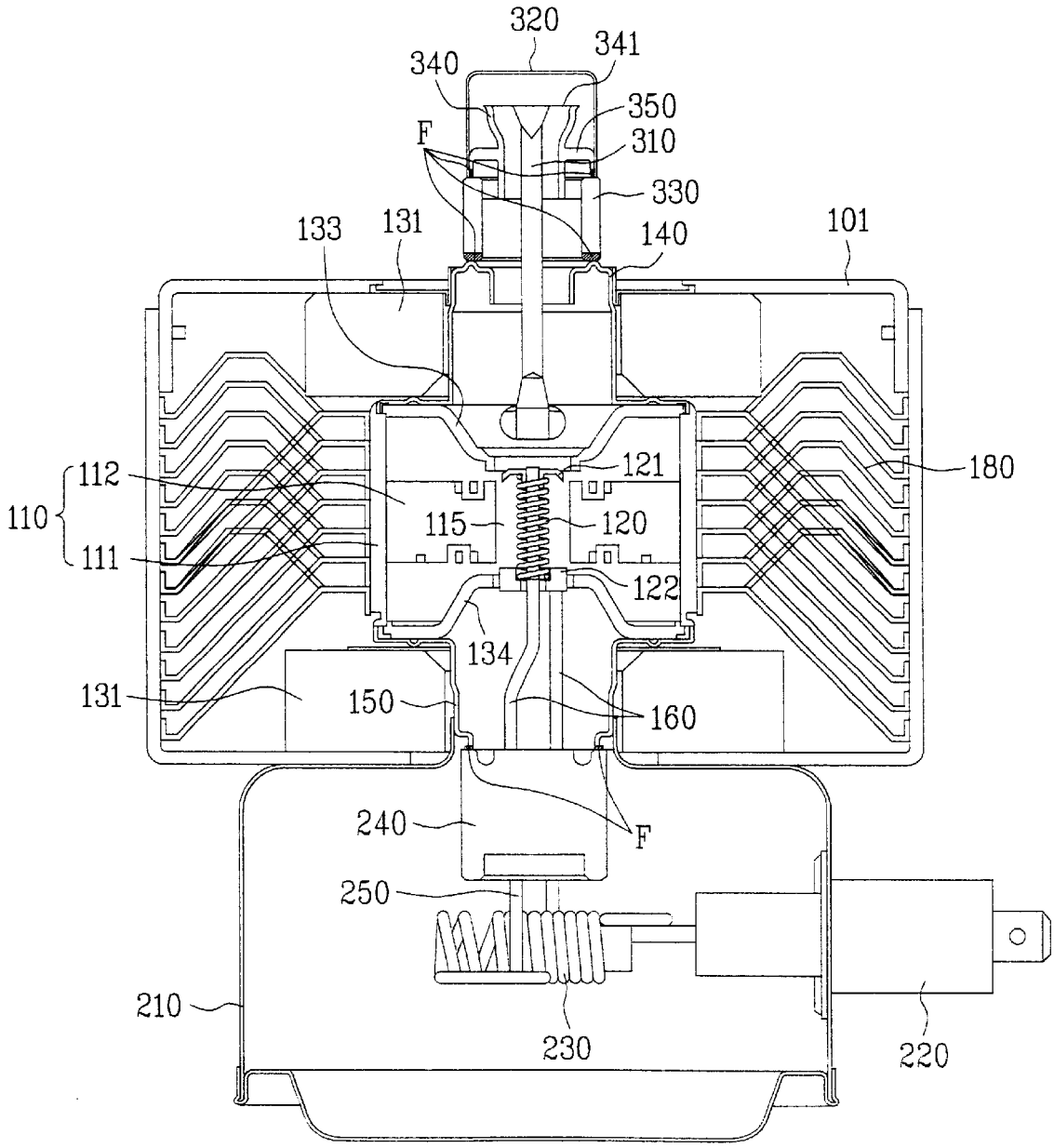
FIG. 2 illustrates a section of a whole magnetron in accordance with a preferred embodiment of the present invention.

As shown in FIG. 2, an anode 110 includes an anode cylinder 111 and anode vanes 112. The anode cylinder 111 is cylindrical with an open top and bottom. The anode vanes 112 are projected in a radial direction from an inside circumference of the anode cylinder 111. Spaces are provided between adjacent anode vanes 112 for resonant cavities.

A filament 120 and a cathode 115 are fitted in a center space of the plurality of vanes 112. An interaction space is provided between the filament 120 and ends of the anode vanes 112, in which an electric field interacts with a magnetic field. An upper end shield 121 and a lower end shield 122 are provided at top and bottom, respectively, of the filament 120. A pair of filament leads 160 is connected to the lower end of the filament 120.

An upper pole piece 133 is fitted to the inside of top opened end of the anode cylinder 111 perpendicular to axes of the anode 110 and the filament 120. A lower pole piece 134 is similarly fitted to the inside of bottom of opened end of the anode cylinder 111.

An upper seal 140 and a lower seal 150 are fitted to top and bottom, respectively, of the anode cylinder 111. Both the upper seal 140 and the lower seal 150 are cylindrical containers formed of metal. The upper seal 140 is formed between the top of the anode cylinder 111 and an upper ceramic 330, and the lower seal 150 is formed between the bottom of the anode cylinder 111 and a ceramic stem 240, as explained later.

A pair of magnets 131 are provided at outer circumferences of the cylindrical upper seal 140 and the cylindrical lower seal 150, respectively. A yoke 101 surrounds the foregoing components. The yoke 101 forms a magnetic circuit, together with an upper pole piece 133 and a lower pole piece 134. A plurality of cooling pins 180 have one set of ends arranged to surround an outer circumference of the anode cylinder 111. The other end set of ends of the cooling pins 180 are arranged within an inside space of the yoke 101 to dissipate heat generated at the anode 110.

Figure 3:
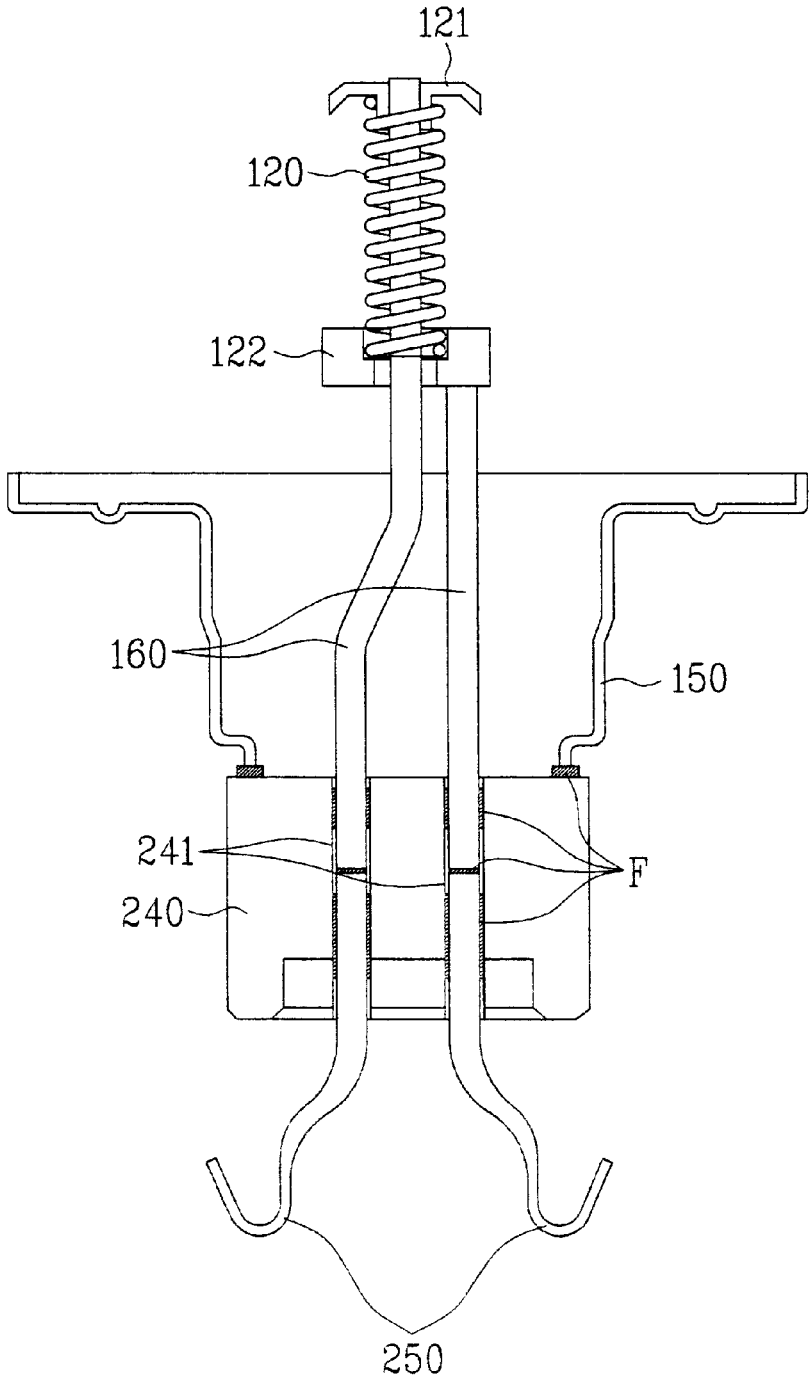
FIG. 3 illustrates a section showing joints of filament leads and external leads of a magnetron in accordance with a first preferred embodiment of the present invention.

A ceramic stem 240 is provided at the bottom of the lower seal 150. A choke coil 230 is provided below the ceramic stem 240. A pair of external leads 250, shown in FIG. 3, are connected both to the choke coil 230, and a pair of the filament leads 160 through an insertion hole 241 which passes vertically through the ceramic stem 240, which will be explained, later.

A filter box 210 is provided under the yoke 101 to hold the ceramic stem 240 and the choke coil 230. A condenser 220 is provided at one side of the filter box 210. The condenser 220 is connected to the choke coil 230 in the filter box 210 to apply power to the filament 120.

An antenna feeder 310 is fitted such that a lower end thereof is connected to any one of the anode vanes 112. An upper end of the antenna feeder 310 is connected to a tip-off 341 at the top end of an exhaust pipe 340. As shown in FIG. 2, the exhaust pipe 340 is supported on an exhaust pipe supporter 350 fixed to the top of the upper ceramic 330. An antenna cap 320 is fitted to enclose the exhaust pipe 340 and the tip-off 341. The upper ceramic 330 is fitted between the lower end of the antenna cap 320 and the upper seal 140.

In the foregoing magnetron of the present invention, in one aspect, it is preferred that a vacuum is maintained within the exhaust pipe 340, the upper ceramic 330, the upper seal 140, the anode cylinder 111, and the lower seal 150 down to the top of the ceramic stem 240 is maintained at a vacuum. Therefore, exhaust pipe 340, the upper ceramic 330, the upper seal 140, the anode cylinder 111, the lower seal 150, and the ceramic stem 240 are joined as tightly as possible to prevent leakage of the vacuum.

To achieve this, the ceramic stem 240 is joined to the lower seal 150. The upper ceramic 330 is joined to the upper seal 140. The upper ceramic 330 is joined to the exhaust pipe supporter 350. Each of them are joined with a joint material F.

Accordingly, the joint material F is provided to joint parts between metal components and ceramic components in the magnetron. That is, the joint material F is provided at joint parts between the exhaust pipe supporter 350 and the upper ceramic 330, a joint part between the upper seal 140 and the upper ceramic 330, and between the lower seal 150 and the ceramic stem 240. The joint material F is made to diffuse under preset temperature and environment to infiltrate an inner part of the ceramic components, thereby joining the metal and ceramic components. Unlike the related art magnetron in which the two components are joined by brazing, in the magnetron of the present invention, the two components which are joined do not require formation of a metal film on the surfaces of the upper ceramic 330 and the ceramic stem 240 by metalizing in advance. This is because the joint material F of the present invention is not applied by a process such as soldering or the like. Rather, a kind of active brazing filler which is activated by a given external condition of the joint material is provided to the joint part in advance, and diffused to infiltrate into an inner part of the ceramic component. This joining principle of the present invention is identical to the diffusion welding principle.

The joint material F of the present invention is also, provided to the joint part of the filament leads 160 and the external leads 250, and used in joining these sets of components, as will be explained with reference to FIGS. 3–5. The filament leads 160 and the external leads 250 are not formed together, but separately, and then joined. This is done because it is economical that while minimizing lengths of the filament leads 160 of expensive molybdenum, the external leads 250 are formed of an inexpensive alternative material, such as stainless steel or pure steel, and the two components are joined together.

FIG. 3 illustrates a section showing joints of filament leads and external leads of a magnetron in accordance with a first preferred embodiment of the present invention.

As shown in FIG. 3, a pair of insertion holes 241 passes vertically through the ceramic stem 240, with the pair of the filament leads 160 and the pair of external leads 250 inserted therein on opposite sides of insertion holes 241. Ends of the pair of the filament leads 160 and the pair of external leads are joined in the insertion holes. Accordingly, the joint material F is provided between the filament leads 160 and the external leads 250, between the filament leads 160 and the insertion holes 241, and between the external leads 250 and the insertions holes 241. Applying the joint material in the insertion hole 241 prevents leakage of the vacuum after the joining.

Figure 4:
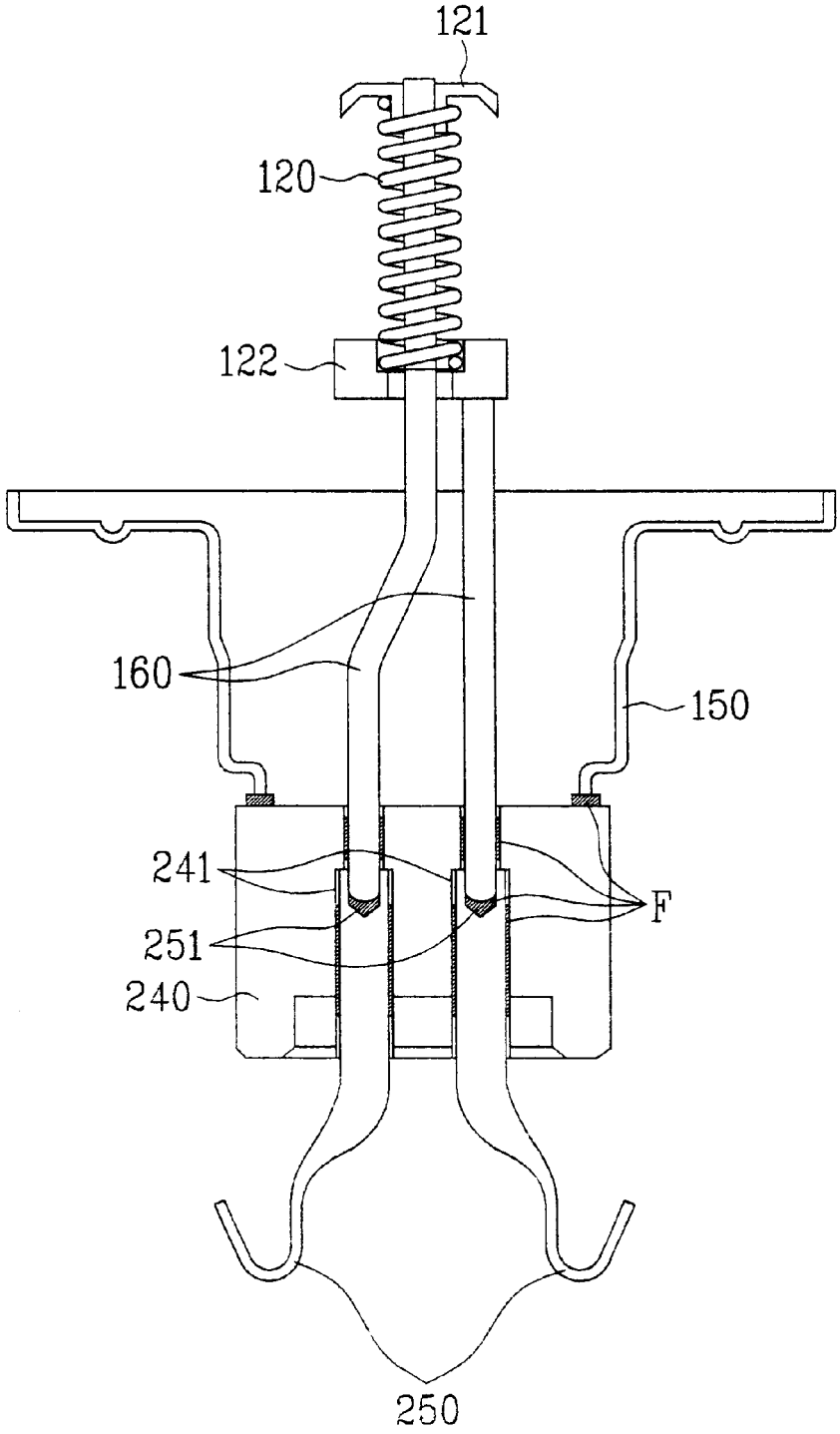
FIG. 4 illustrates a section showing joints of filament leads and external leads of a magnetron in accordance with a second preferred embodiment of the present invention.

FIG. 4 illustrates a section showing joints of filament leads and external leads of a magnetron in accordance with a second preferred embodiment of the present invention.

As shown in FIG. 4, a pair of insertion holes 241 passes vertically through the ceramic stem 240. Each of the insertion holes 241 has an upper part, and a lower part having a diameter larger than the upper part. The lower part receives an external lead 250 having a diameter larger than the filament lead 160. This method is used generally to fabricate smaller filament leads 160 of expensive molybdenum and to fabricate the external leads of inexpensive stainless steel or pure steel to reduce costs. For closer joining of the two different diametered leads, the following method of joining is preferred.

As shown in FIG. 4, the external lead 250 has a recess 251 in an end part thereof, into which an end of the filament lead 160 is inserted and joined firmly with the joint material F. To achieve this, the recess 251 has an inside diameter slightly larger than the diameter of the filament lead 160. The joint material is provided to the inside of the recess 251 and to an upper part and a lower part of the insertion hole 241.

Figure 5:
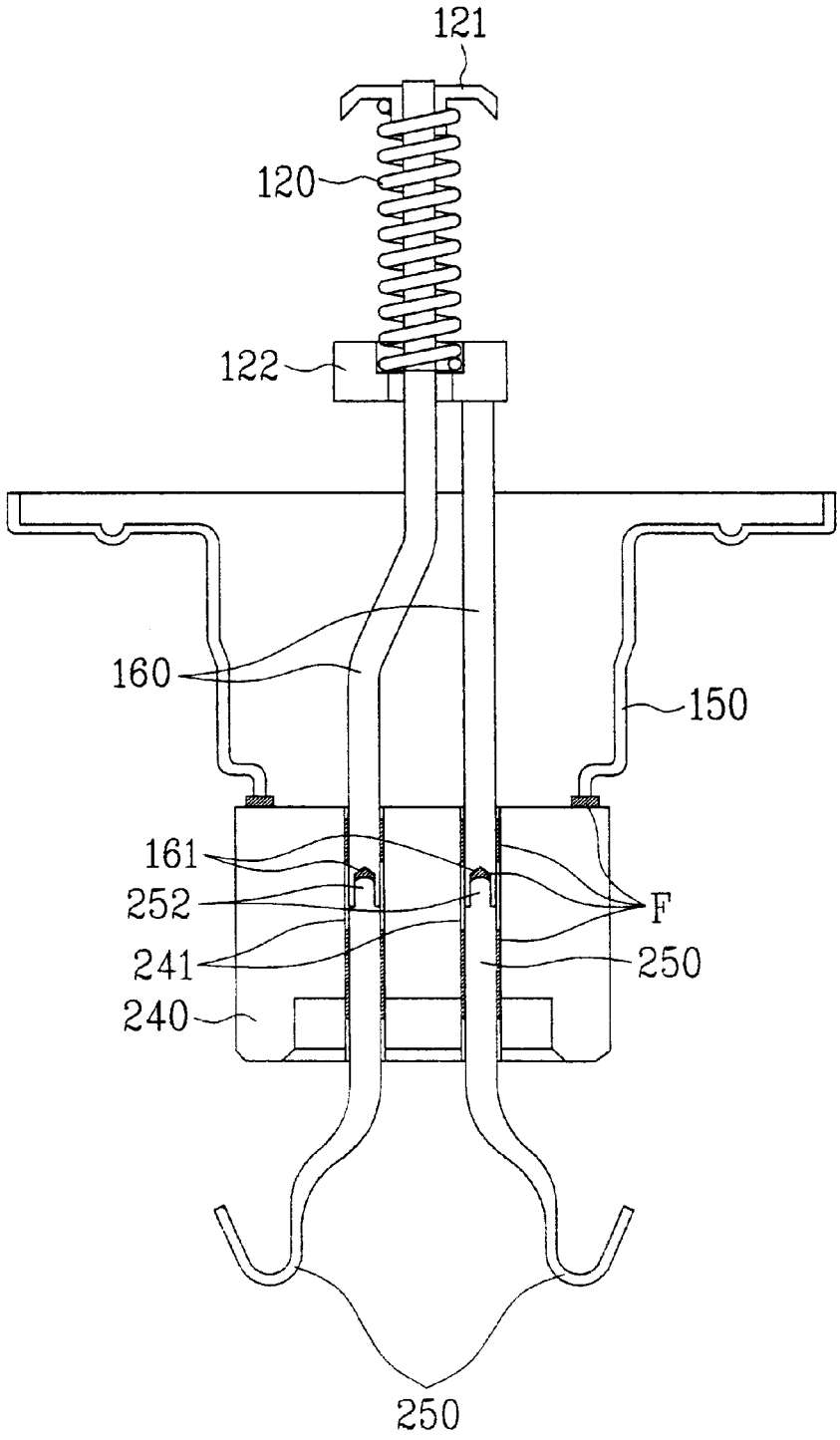
FIG. 5 illustrates a section shoving joints of filament leads and external leads of a magnetron in accordance with a third preferred embodiment of the present invention.

FIG. 5 illustrates a section showing, joints of filament leads and external leads of a magnetron in accordance with a third preferred embodiment of the present invention.

As showing in FIG. 5, a pair of uniform diametered insertion holes 241 passes vertically through the ceramic stem 240. Filament leads 160 and external leads 250 are inserted in the insertion holes 241 from an upper side and a lower side of the insertion holes 241 and joined with the joint material F. A filament lead 160 has a recess 161 in one end thereof, and the external lead 250 has a tip 252 that fits in the recess 161. The joint material F is provided to an inside of the recess 161, and to an upper part and a lower part of the insertion hole 241.

Therefore, according to FIGS. 3–5, unlike the related art, in which the pair of filament leads 160 and the pair of external leads 250 are brazed on opposite sides of the terminal plate of metal, the direct joining of the pair of filament leads 160 and the pair of external leads 250 within the insertion holes 241 in the ceramic stem 240 facilitates an easy joining and prevents vacuum leakage caused by defective joining.

The joint material F may be an alloy of silver and copper as main composition, which takes a joint strength and air tightness into account. Additives may be added to the alloy to make diffusion and infiltration into the ceramic mother member possible and to enhance joint strength. The additives may be selected from a group of material including titanium, tin, and zirconium.

The joint material, which is an alloy of silver-copper additives, may comprise the following in weight percentages: 60 to 80 silver, 10 to 39 copper, and 1 to 10 titanium, if the joint material F is composed of silver-copper-titanium. The joint material F may comprise 60 to 80 silver, 10 to 39 copper, and 1 to 10 zirconium if the joint material F is composed of silver-copper-zirconium.

Figure 6:
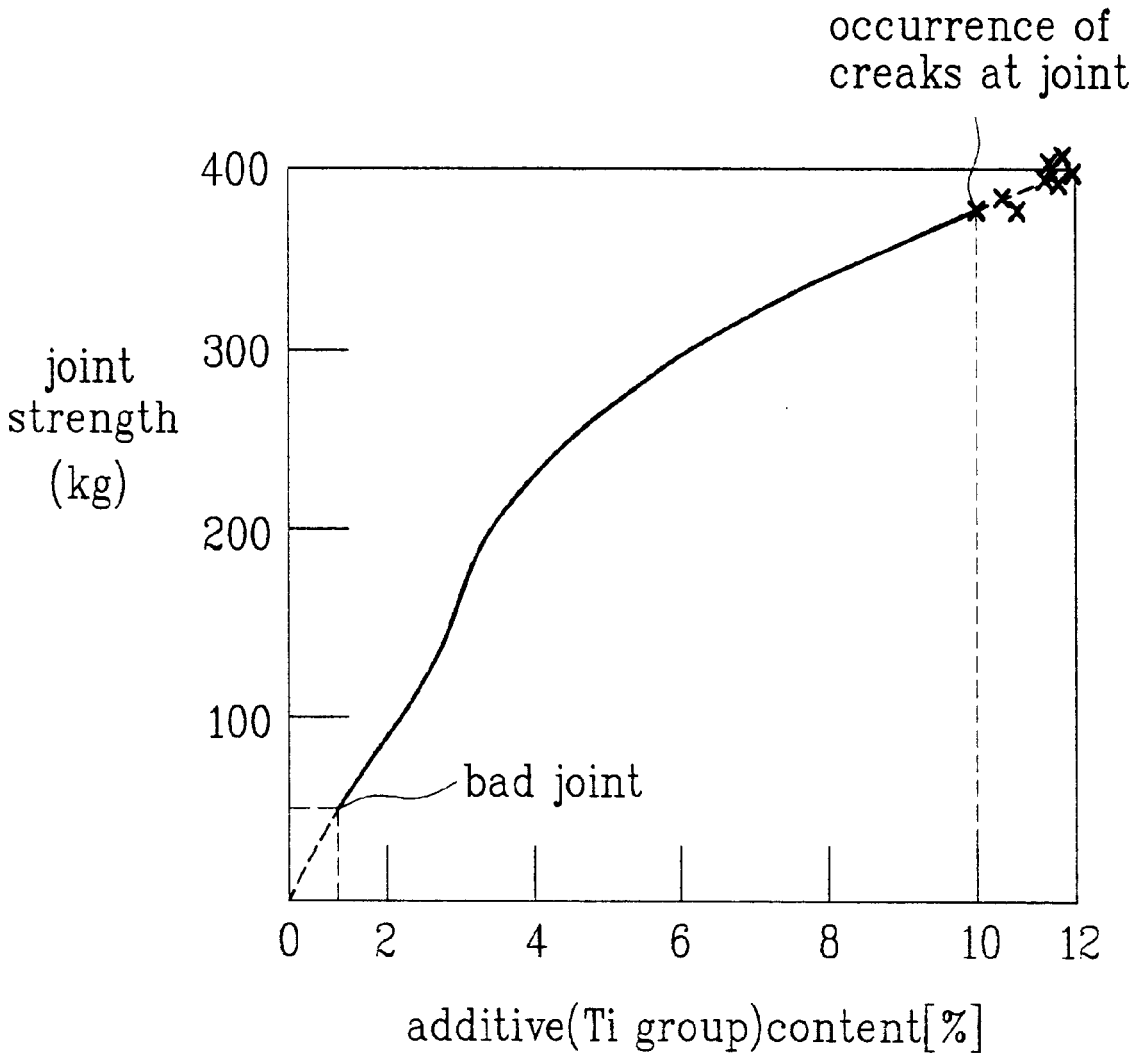
FIG. 6 illustrates a graph showing weight % of an additive to a joining component versus a joint strength in accordance with a preferred embodiment of the present invention.

As shown in FIG. 6, because the joint strength drops approximately below 50 Kg if the content of the additive, such as titanium, drops below 1%, the joint becomes liable to breakage even in response to a weak external force, thus resulting in a defective joint which fails to maintain the vacuum due to the low joint strength. Since failure to maintain the vacuum results in failure to generate the microwave, losing a function of the magnetron, the content of the additive in the joint material F should be higher than 1%. On the other hand, if the additive content is higher than 10%, a substantial amount of the joint material F is diffused and infiltrates the ceramic components, for example, the upper ceramic 330 and the ceramic stem 240 and starts to cause cracks therein. The higher the additive content, the greater the number of cracks, which results in failing of the maintenance of the vacuum. Thus, though a reliability of the joint is enhanced with a higher additive content, the stronger the joint strength, excessive content, causing excessive infiltration into the ceramic components, results in a greater occurrence of cracks in the ceramic components. Thus, there are limits to the content of the additive, because of these restrictions. Based on the above experimental data, the present invention suggests an additive content in a range of from 1 to 10%.

Figure 7:
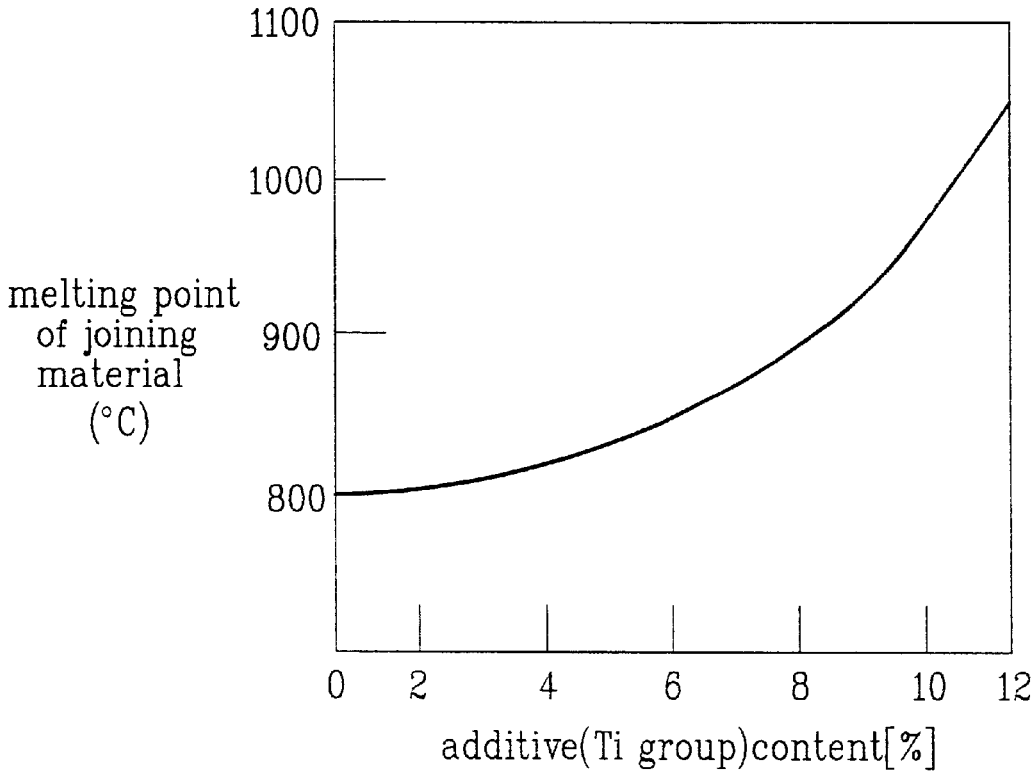
FIG. 7 illustrates a graph showing weight % of an additive to a joining component versus a melting point of the joining component in accordance with a preferred embodiment of the present invention.

On the other hand, there is another criterion required for determining the percentage of additive content. If the percentage of the additive content, such as titanium, is increased only taking the joint strength into consideration even within the range where no crack occurs, there is another problem. This problem is related to the joining temperature. In detail, referring to FIG. 7, if the additive content is increased, a melting point of the joint material rises, which has the following unfavorable effects. First, a higher temperature furnace is required as the melting point of the joint material rises. Second, if the melting point of the joint material rises, to approach a melting point of a material used as a metal component of the mother members, such as Cu (MP:1080° C.) and Fe (MP:1400° C.), the joining cannot be done if the mother member is damaged is as the mother member starts to melt. Therefore, the melting point of the joint material should be lowered, and, taking this aspect into consideration, a composition ratio of the additive is determined. Since the most ideal composition ratio of silver-copper having the lowest melting point is approx. 7:3, the present invention suggests silver-copper-additive (in case of titanium) of 65 to 68:27 to 32:2 to 5 as an optimal weight ratio obtained from numerous experiments taking all above requirements into consideration.

A method for joining magnetron components will be explained in detail.

As shown in FIG. 2, a joint material F is provided to a joint part of filament leads 160 of molybdenum and the external leads 250 of stainless steel or pure steel, and joint parts between metal components and ceramic components. The joint parts between metal components and ceramic components includes an insertion hole 241 space between the filament leads 160 and the ceramic stem 240, an insertion hole 241 space between the external leads 250 and the ceramic stem 240, a joint part of the lower seal 150 and the ceramic stem 240, and a joint part of the upper seal 140 and the upper ceramic 330, and the upper ceramic 330 and the exhaust pipe support 350.

When the joint material is provided to an inside wall surface of the insertion hole 241, after a sheet of the insertion material rolled into a cylindrical form is inserted into the insertion hole 241, or a cylindrical form of the joint material, already prepared, is inserted into the insertion hole 241, the filament lead 160 and the external leads 250 are inserted from opposite sides of the insertion hole 241 through an inside of the cylindrical joint material. The joint material F may also be provided to the inside wall surface of the insertion hole 241 with the joint material divided into many pieces. Or the sheet of joint material may be rolled around an outer circumference of the filament lead 160 or the external lead 250 before inserting into the insertion hole 241.

The joint material F is also provided to the joint part between an end of the filament lead and an end of the external lead 250, which are both joined to an inside of the insertion hole. When the joint material F is provided to the joint part between the end of the filament lead and the end of the external lead 250, the following different methods may be applicable depending on forms of joining of the filament lead 160 and the external lead 250, one of which will be explained, with reference to FIG. 4.

A recess 251 is formned in an end of the external lead 250, having a diameter greater than an end of the filament lead 160. The joint material F is placed in the recess 251. Once the joint material F is placed, the end of the filament lead 160 is inserted into the recess 251.

Another method will be explained with reference to FIG. 5. A recess 161 is formed in an end of the external lead 250. Then, a tip 252 is formed at the end of the external lead 250 for insertion into the recess 161. There is no order of the steps of forming the recess 161 and the tip 252 in view of time. If necessary, the tip is formed at the filament lead 160 first, and the recess 161 may be formed in the external lead 250 next. Then, after the joint material is placed in the recess 161, the tip 252 is inserted in the recess 161, to finish providing the joint material.

The thickness of the joint material F substantially affects the joint strength and the air tightness. That is, if the joint material is too thick, a substantial amount of the joint material infiltrates into the ceramic component, to cause cracks in the ceramic component. As a gap between the jointed components becomes the larger, the air tightness becomes the poorer. On the other hand, if the joint material is too thin, the joint strength between the components becomes poor. Taking these conditions into consideration, it is preferable that the thickness of the joint material F is 50–200 $\mu$m.

When the placing of the joint material F is finished, the joint material is exposed to a preset temperature and a preset environment, so that the joint material F is diffused, and infiltrates into the joint part. The preset temperature and the preset environment applied to the joint material F are major factors that influence activity of the joint material F.

Figure 8:
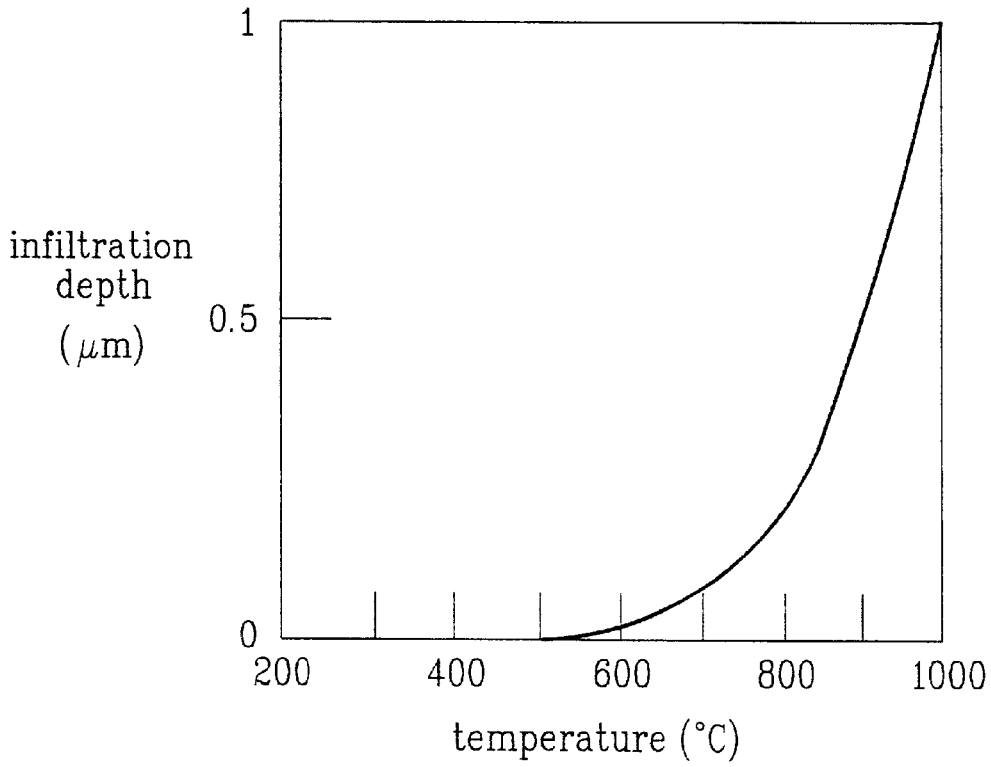
FIG. 8 illustrates a graph showing a diffusion depth to a joining component versus a temperature in accordance with a preferred embodiment of the present invention.

FIG. 8 illustrates a graph showing a diffusion depth of a joint material into a joining component versus a temperature in accordance with a preferred embodiment of the present invention, wherein it can be noted that an infiltration depth and infiltration rate of the joint material are influenced from the temperature. FIG. 8 illustrates an example when a ratio of silver-copper-titan composition of the joint material is 67:30:3 in weight percentage, where the ordinate represents a depth of infiltration, and the abscissa represent the temperature. The joint material starts solid state diffusion at about 500° C., and starts liquid state diffusion at a temperature higher than about 800° C. as the joint material F approaches a melting point and infiltrates into the ceramic base member rapidly, with a rapid increase of the depth of infiltration. Since a minimum of 0.2 $\mu$m of the infiltration depth of the joint material F is required for prevention of a joint defect, and an infiltration depth greater than about 1.0 $\mu$m causes occurence of cracks to occur in the base member, the temperature to which the joint material F is exposed should be determined by taking the infiltration depth into account even if the joint materials have the same composition. Accordingly, the lowest exposure temperature should be higher than melting point of the joint material F, and a highest exposure temperature is a temperature at which the infiltration depth becomes less than 1.0 $\mu$m. Of course, the exposure temperature should be lower than melting points of metallic base members to avoid thermal deformation and melting of the metallic members adjacent to the joint material, such as the upper seal 140, the lower seal 150, and the exhaust pipe supporter 350. Therefore, the exposure temperature of the joint material F is suggested in the range of from about 800–1000° C.

Figure 9A:
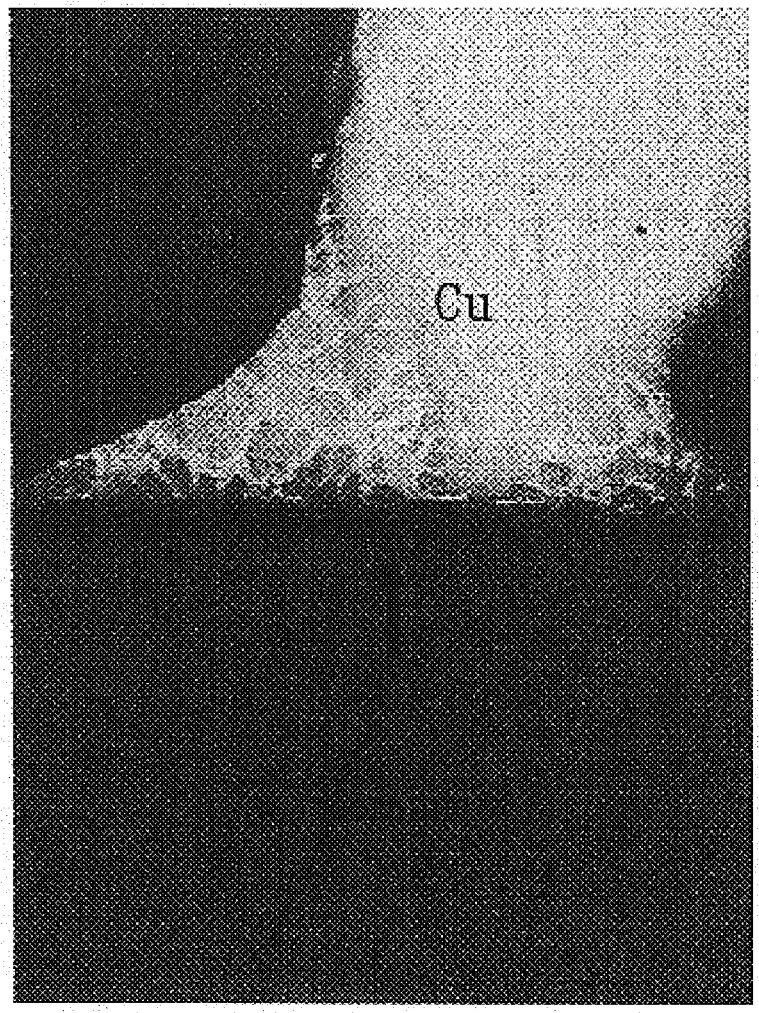
FIG. 9A illustrates a photograph showing good joint of an actual joint part.
Figure 9B:
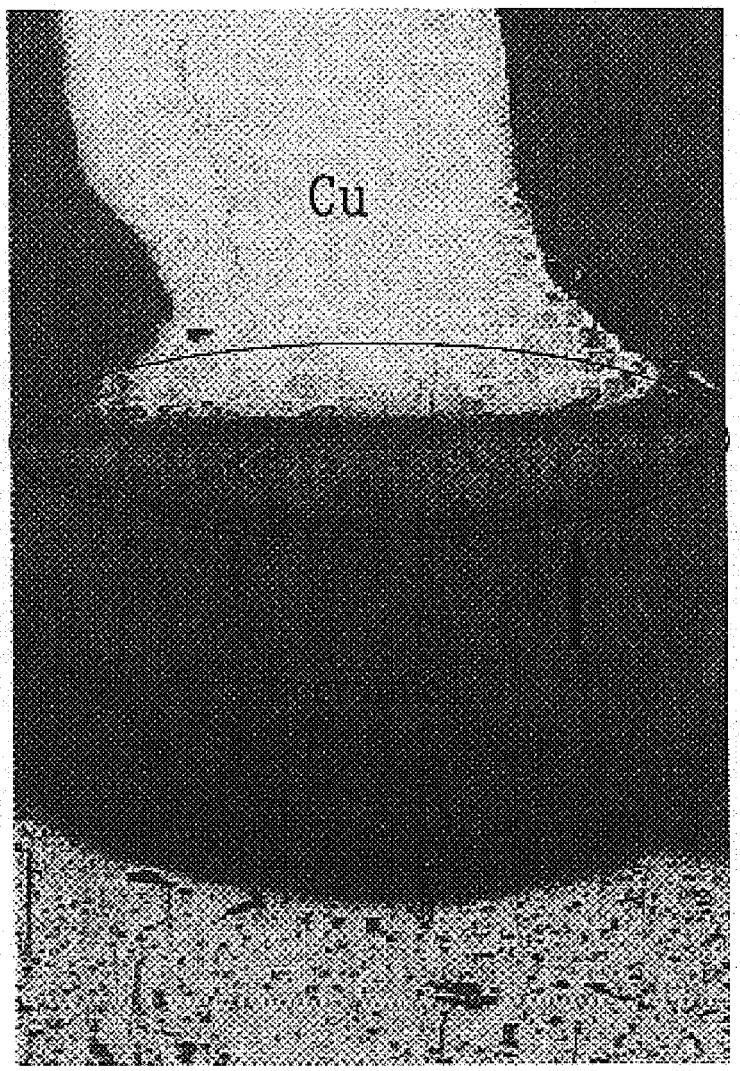
FIG. 9B illustrates a photograph showing poor joint of an actual joint part caused by excessive diffusion of a joining member.

FIG. 9A illustrates a photograph showing good joint of an actual joint part, and FIG. 9B illustrates a photograph showing poor joint of an actual joint part caused by excessive diffusion of a joining member. FIG. 9A illustrates a photograph of a specimen showing a good joint of coalesced copper Cu and ceramic, where a joint indicated by an arrow is a uniform. By contrast, FIG. 9B illustrates the joining material infiltrated into the ceramic component to a substantial depth, to form one more non-uniform boundary layer in a lower side, to cause cracks due to excessive infiltration. Therefore, a good joint can be provided only when the joining is carried out by a method suggested in the present invention considering the above various conditions.

In the meantime, the joining material F may be exposed to a vacuum along with the temperature, for prevention of oxidation and activity of the joining material F. The joining material should be joined at a vacuum higher than at least $1\times10^{-3}$ torr for effective prevention of joint defect caused by oxidation, and an optimal condition is joining at a vacuum in a range of $1\times10^{-3}$ torr.

The joining of the joining material F may be carried out in a condition where the joining material F is exposed to the above temperature, as well as using hydrogen gas and or argon gas.

Then, once the infiltration of the joining material is finished, the joining of the joint is finished by cooling down the joining material F. The joining material may be cooled down at a room temperature naturally, or artificially by an external heat source.

The operation of the magnetron of the present invention fabricated by the foregoing method will be explained.

When a current is provided to the filament 120 through the filament leads 160, thermal electrons are emitted from the filament 120. As a high voltage is provided between the filament 120 and the anode 110, an electric field is formed. At the same time with this, a magnetic field is formed by one pair of magnets 131, and focused to an inside of the anode cylinder 111.

The electric field and the magnetic field interact in an action space between edges of the anode vanes 112 and the filament 120, to generate a microwave.

The microwave generated thus is transmitted through the antenna feeder 310, and radiated to outside of the magnetron through the upper ceramic 330 and the antenna cap 320.

As has been explained, the magnetron of the present invention has the following advantages.

First, the infiltration type joining of the joining material F between metal component and the ceramic component provides, not only a high joint strength, but also a high air tightness, thereby improving a reliability of the magnetron as the vacuum leakage caused by defective joint can be prevented.

Second, the joining of the filament lead 160 and the external lead 250, not through the additional terminal plate, but through the joining material F permits a simple component assembly process, and a simple magnetron fabrication process.

The infiltration type joining of the joining material F between various metal components and the ceramic components permits to dispense with the metalizing process surface of the ceramic component, thereby permitting simplification of the fabrication process and reduction of a fabrication cost.

Fourth, different from the metalizing which is carried out at a high temperature furnace at a temperature higher than 1600° C. in the related art, the melting, and infiltrating of the joining material F into the ceramic component at from about 800 to 1000° C. permits to carry out the fabrication at a low temperature furnace. Since the low temperature furnace is generally used in fabrication of the magnetron, the employment of the joining material F of the present invention permits joining of different components only with exiting equipment, without providing additional equipment. Therefore, the equipment be saved.

It will be apparent to those skilled in the art that various modifications and variations can be made in the magnetron of the present invention without departing from the spirit or scope of the invention. Thus, it is intended that the present invention cover the modifications and variations of this invention provided they come within the scope of the appended claims and their equivalents.

What is claimed is:

1. A magnetron comprising:

an anode having an anode cylinder and a plurality of anode vanes;

a cathode having a filament;

a condenser, a choke coil, and a plurality of leads for providing a power to the filament;

a plurality of magnets and pole pieces, and a yoke for forming a magnetic circuit;

an antenna feeder and an antenna cap for transmitting a generated microwave outside of the magnetron; and a plurality of joints formed of a joining material between a metal component and a ceramic component of the magnetron, wherein the joining material is diffused between the metal component and the ceramic component, to infiltrate into an inner part of the ceramic component directly, thereby joining the metal and ceramic components.

2. The magnetron as claimed in claim 1, wherein the joint is provided at a part between an upper seal on top of the anode cylinder and an upper ceramic at a bottom of the antenna cap.

3. The magnetron as claimed in claim 1, wherein the joint is provided at a part between an exhaust pipe supporter of a metal, which supports all exhaust pipe that surrounds a top end of the antenna feeder, and an upper ceramic under the antenna cap.

4. The magnetron as claimed in claim 1, wherein the joint is provided at a part between a lower seal under the anode cylinder and a ceramic stem provided to permit pass of a plurality of leads.

5. The magnetron as claimed in claim 1, wherein the joint is provided to an inside of an insertion hole in the ceramic stem the leads pass therethrough.

6. The magnetron as claimed in claim 1, wherein the joint is provided at a part between a filament lead connected to the filament and the external lead connected to the choke coil.

7. The magnetron as claimed in claim 6, wherein the external lead has a diameter the same with, or greater than a diameter of the filament lead.

8. The magnetron as claimed in claim 7, wherein the external lead has a recess in an end thereof, for insertion of an end of the filament lead.

9. The magnetron as claimed in claim 7, wherein the filament lead has a depth of recess in an end thereof, and the external lead has a tip at an end thereof for insertion into the recess.

10. The magnetron as claimed in claim 1, wherein the joining material is an alloy of silver-copper-additive.

11. The magnetron as claimed in claim 10, wherein the additive has a content of from 1 to 100 wt %.

12. The magnetron as claimed in claim 10, wherein the joining material has a composition ratio of silver:copper:additive in weight percentages of 60 to 80:10 to 39:1 to 10.

13. The magnetron as claimed in claim 10, wherein the additive is a material selected from at least one of titanium, tin, and zirconium.

14. The magnetron as claimed in claim 13, wherein the joining material has a composition ratio of silver:copper:titanium in weight percentages of 60 to 80:10 to 39:1 to 10.

15. The magnetron as claimed in claim 13, wherein the joining material has a composition ratio of silver:copper:tin in weight percentages of 60 to 80:10 to 39:1 to 10.

16. The magnetron as claimed in claim 13, wherein the joining material has a composition ratio of silver:copper:zirconium in weight percentages of 60 to 80:10 to 39:1–10.

17. The magnetron as claimed in claim 13, wherein the joining material has a composition ratio of silver:copper:titanium in weight percentages of 60 to 68:27 to 33:2 to 5.

18. A method for joining magnetron components comprising the steps of.

(a) providing a joining material at parts to be joined inclusive of parts between a metal component and a ceramic component, and between a filament lead and an external lead;

(b) exposing the joining material to a preset temperature and a preset environment, so that the joining material diffuses into the part to be joined and infiltrates into an inner part of the ceramic component; and (c) cooling down the joining material so that the joining material joins the part to be joined.

19. A method as claimed in claim 18, wherein the step (a) includes the steps of:

(a1) providing the joining material at a part between a lower seal under the anode cylinder and a ceramic stem, (a2) providing the joining material at a part between an upper seal on top of the anode cylinder and an upper ceramic under an antenna cap, (a3) providing the joining material at parts between an insertion hole in the ceramic stem and a filament lead passed through the insertion hole, and between the insertion hole and an external lead passed through the insertion hole, and (a4) providing the joining material at a part between the filament lead and the external lead.

20. A method as claimed in claim 19, wherein the step (a3) includes the steps of:

rolling a sheet of the insertion material rolled into a cylindrical form, and inserting into the insertion hole, to provide the joining material to an inside wall surface of the insertion hole, and inserting the filament lead and the external leads into the insertion hole from opposite sides of the insertion hole through an inside of the cylindrical joint material.

21. A method as claimed in claim 19, wherein the step (a3) includes the steps of:

inserting a cylindrical form of the joining material already prepared into the insertion hole, to provide the joining material to an inside wall surface of the insertion hole, and inserting the filament lead and the external leads into the insertion hole form opposite sides of the insertion hole through an inside of the cylindrical joint material.

22. A method as claimed in claim 19, wherein the step (a4) includes the steps of:

forming a recess in an end of the external lead, placing the joining material in the recess, and inserting an end of the filament lead into the recess.

23. A method as claimed in claim 19, wherein the step (a4) includes the steps of;

forming a recess in an end of the filament lead, and forming a tip at an end of the external lead, placing the joining material in the recess, and inserting the tip into the recess.

24. A method as claimed in claim 18, wherein the step (a) includes the step of providing a joining material to a thickness of from about 50 to 200 $\mu$m.

25. A method as claimed in claim 18, wherein the step (b) includes the step of exposing the joining material to a temperature range of from about 800 to 1000° C., for diffusing and infiltrating the joining material.

26. A method as claimed in claim 18, wherein the step (b) includes the step of exposing the joining material to a vacuum, for diffusing, and infiltrating the joining material.

27. The method as claimed in claim 26, wherein the vacuum is about $1\times10^{-3}$ to $1\times10^{-5}$ torr.

28. The method as claimed in claim 25, wherein the step (b) includes the step of exposing the joining material to hydrogen gas, for diffusing, and infiltrating the joining material.

29. A method as claimed in claim 25, wherein the step (b) includes the step of exposing the joining material to argon, for diffusing, and infiltrating the joining material.

* * * * *